US006299031B1

(12) United States Patent
Cavallaro et al.

(10) Patent No.: US 6,299,031 B1
(45) Date of Patent: Oct. 9, 2001

(54) DISPENSING APPARATUS AND METHOD

(75) Inventors: William A. Cavallaro, Bradford, MA (US); William M. Kocsis, Jr., Clearwater, FL (US); Jeffrey P. Fugere, Sandown, NH (US)

(73) Assignee: The Knight Group LLC, Haverhill, MA (US)

( * ) Notice: Subject to any disclaimer, the term of this patent is extended or adjusted under 35 U.S.C. 154(b) by 0 days.

(21) Appl. No.: 09/628,157

(22) Filed: Jul. 28, 2000

Related U.S. Application Data

(60) Provisional application No. 60/146,199, filed on Jul. 29, 1999.

(51) Int. Cl.[7] ..... B65D 88/54

(52) U.S. Cl. ..... 222/334; 222/389; 252/62.51 R

(58) Field of Search ..... 222/326, 334, 222/389; 252/62.51 R

(56) References Cited

U.S. PATENT DOCUMENTS 4,348,160 * 9/1982 Heynemann ..... 222/334
4,942,984 * 7/1990 Miller ..... 222/334
5,452,824 * 9/1995 Danek et al. ..... 222/389

* cited by examiner

*Primary Examiner*—Philippe Derakshani
(74) *Attorney, Agent, or Firm*—Hale and Dorr LLP

(57) ABSTRACT

A pusher is disposed to drive material out of a dispensing outlet and extends into a first chamber that is configured to contain a hydraulic fluid disposed to drive the pusher. A second chamber is configured to exchange hydraulic fluid with the first chamber. A fluid control mechanism is disposed between the first chamber and the second chamber. Air under pressure is applied to urge a rapidly transforming material to flow toward one portion of a bifurcated chamber from another portion of the bifurcated chamber. The driven rapidly transforming material is allowed to drive a material from a dispensing outlet. At least a portion of the rapidly transforming material is caused to physically transform to a form that is more resistant to flowing. The dispensing outlet is caused to change position. At least a portion of the rapidly transforming material is caused to physically transform away from the form that is more resistant to flowing.

25 Claims, 6 Drawing Sheets

DISPENSING APPARATUS AND METHOD

CROSS-REFERENCE TO RELATED APPLICATIONS

This application claims the benefit of U.S. Provisional Application Serial No. 60/146,199 entitled "DISPENSING APPARATUS AND METHOD" filed on Jul. 29, 1999, incorporated herein by reference.

BACKGROUND OF THE INVENTION

This application relates to dispensing.

Many applications call for an automatic mechanism that dispenses a desired amount of a material. For example, in an automatic assembly line used in producing semiconductor-based electronic circuits, when an electronic part such as a chip resistor, a capacitor, or a packaged integrated circuit ("IC") is to be mounted onto a substrate having a circuit pattern formed thereon, creamy solder is deposited in a selected position on the substrate by use of a dispenser and then the electronic part is automatically mounted in the selected position by use of a chip mounter.

The dispenser typically includes a tube needle fixed at a bottom end of the dispenser, a syringe that stores the creamy solder above the tube needle, and a plunger housed within the syringe above the creamy solder in an upwardly and downwardly movable manner for discharging the creamy solder by a downward displacement of the plunger towards the tube needle. The downward displacement of the plunger pushes the creamy solder down within the syringe and discharges the creamy solder from a bottom end of the tube needle.

Typically, the plunger is driven down towards the tube needle by air under pressure. However, air under pressure compresses readily and can escape around the plunger into a space below the plunger. As a result, as air is added under pressure, the plunger may not reliably move downward as desired and creamy solder may not be dispensed in a desired amount.

A desired amount of material may be dispensed by a device that employs an auger or screw that is rotated to cause dispensing. In the device, the rotative force is converted to linear, outward force that drives the material being dispensed.

SUMMARY OF THE INVENTION

Apparatus is provided that includes a dispensing outlet and a pusher disposed above the dispensing outlet. The apparatus further includes a first chamber into which the pusher extends. The first chamber is configured to contain a variable amount of a hydraulic fluid above the pusher. The apparatus further includes a second chamber configured to exchange hydraulic fluid with the first chamber, and a fluid control mechanism disposed between the first chamber and the second chamber. Accordingly, material can be dispensed by the pusher under careful control, to help prevent the material from being dispensed in undesired quantities or at undesired times. In particular, a solder dispensing mechanism can be provided that delivers, from a solder syringe, highly controlled quantities of solder at specified locations in rapid succession.

Other features and advantages will become apparent from the following description, including the drawings, and from the claims.

DETAILED DESCRIPTION

Figure 1:
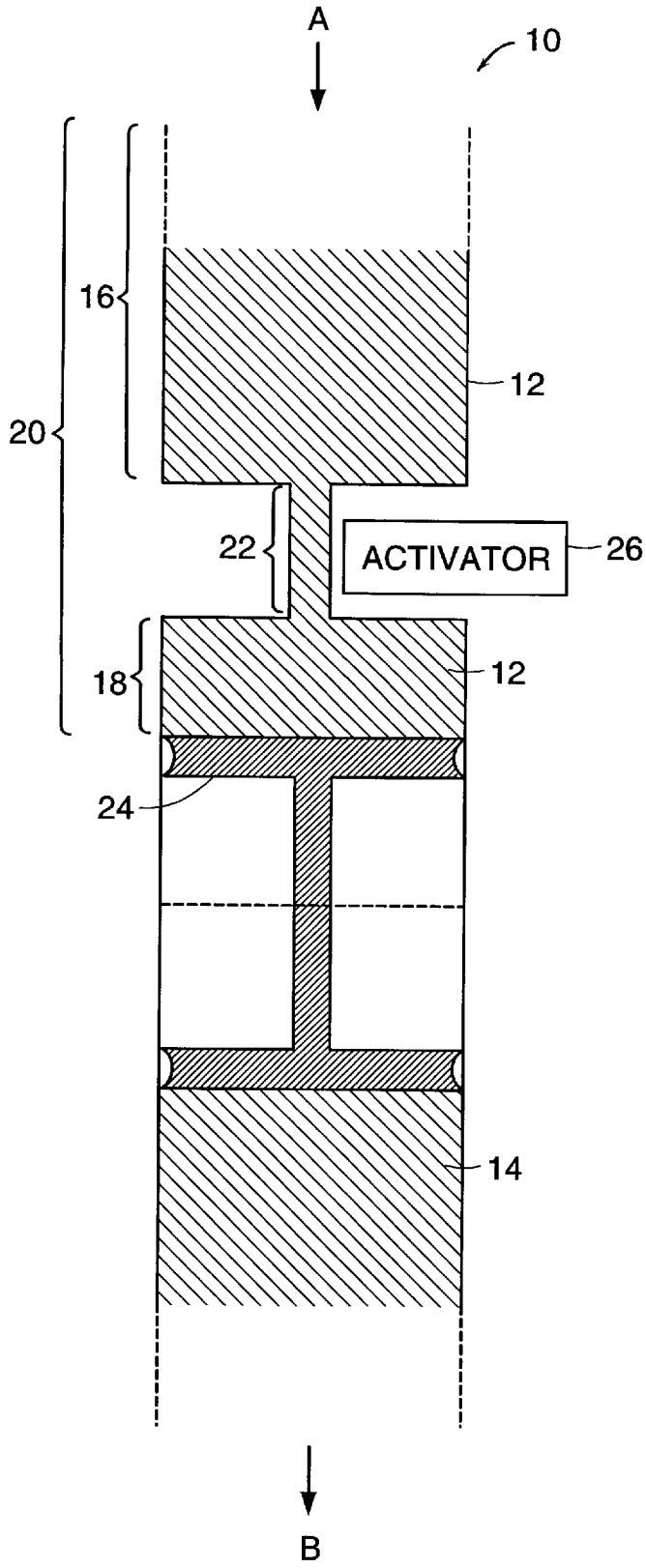
FIG. 1 is a diagram of dispensing apparatus.

FIG. 1 is a block diagram of a dispensing system 10 in which a rapidly transforming ("RT") material 12 such as a magneto-rheological ("MR") material helps to control the amount of outgoing material 14 that is dispensed. Under typical conditions, the RT material is effectively a liquid or other substantially uncompressible fluid. In a hydraulic fashion, in response to a force emanating from a direction A, the RT material flows from a first part 16 to a second part 18 of a bifurcated chamber 20 through a passage 22, causing a transfer mechanism 24 to drive the outgoing material in direction B.

When an activator 26 is toggled, the RT material in the passage undergoes a physical transformation to become effectively a solid and thereby blocks RT material from flowing through the passage. As a result, the force emanating from direction A does not reach the outgoing material, which is therefore no longer driven in direction B.

When the activator is toggled again, the RT material in the passage undergoes a reverting physical transformation, allowing RT material to resume flowing through the passage to drive the outgoing material further in direction B.

Figure 2:
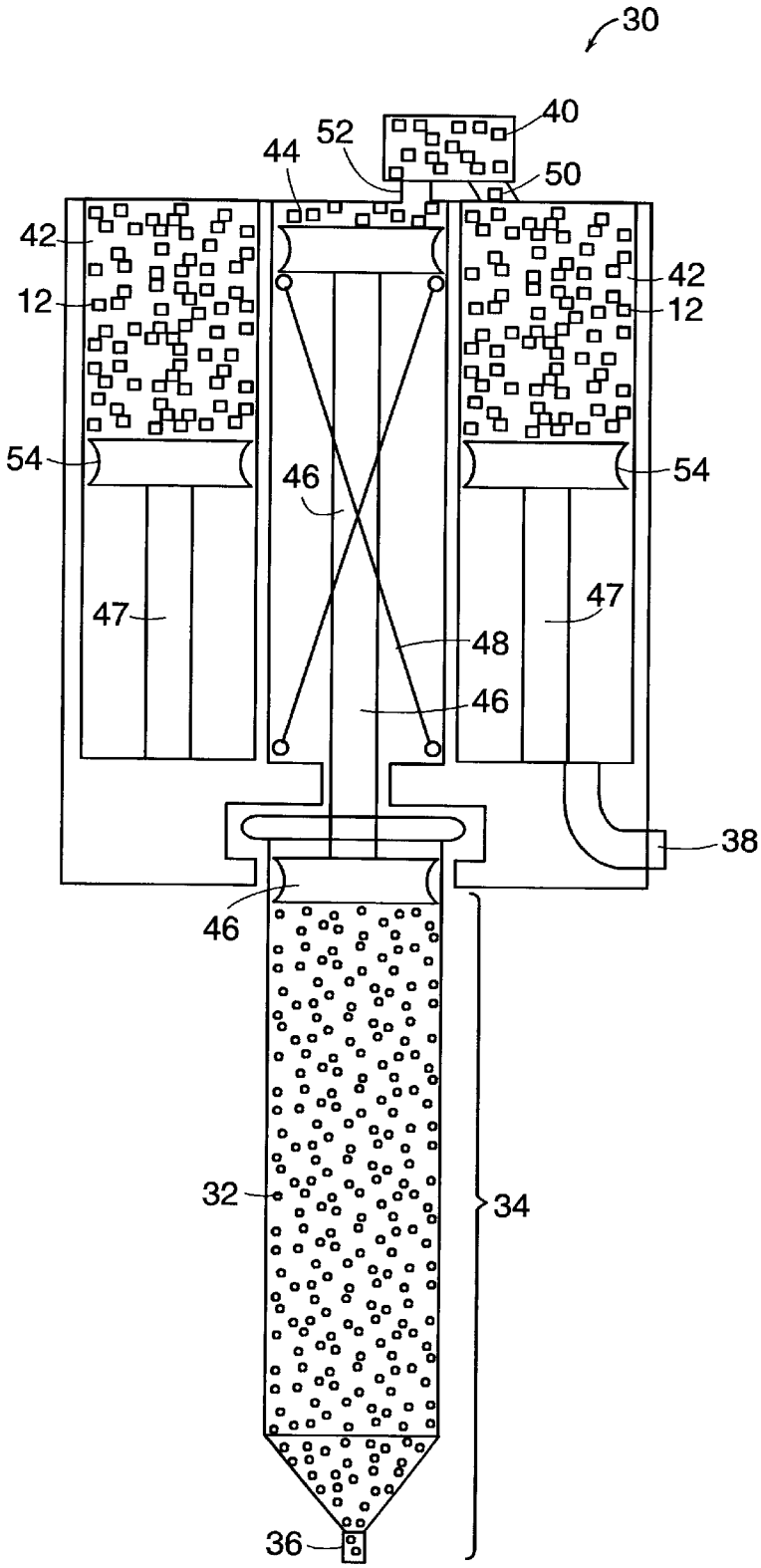
FIGS. 2, 4, and 5A are side views of dispensing apparatus.
Figure 3:
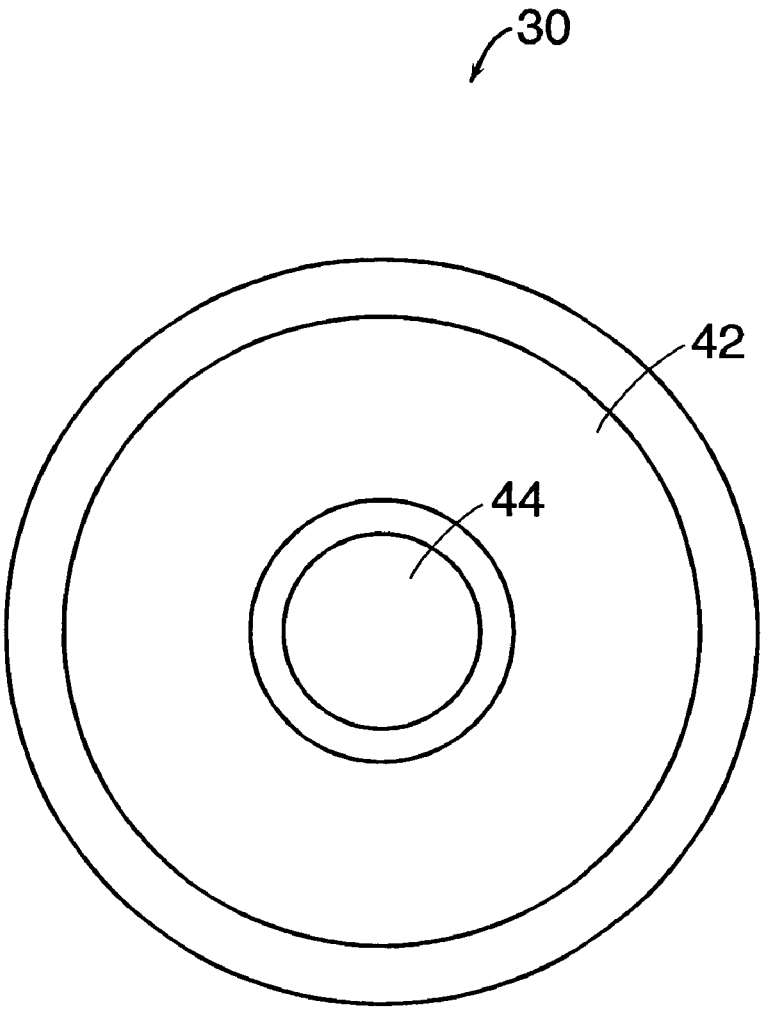
FIG. 3 is a top view of a portion of dispensing apparatus.

FIG. 2 (side view) and FIG. 3 (top view) illustrate an embodiment 30 of the dispensing system 10 (FIG. 1) in which the outgoing material 14 (FIG. 1) is or includes creamy solder 32 provided in a syringe 34 (e.g., a 10 cc syringe) having a tube needle 36, the RT material 12 flows in response to air under pressure 38 such as air under a pressure of at least 50 psi, and the activator 26 (FIG. 1) includes a magnet actuating mechanism 40. (In a typical embodiment, the air under pressure is under a pressure ten to twenty times greater than the air pressure in a conventional mechanism for dispensing solder from a syringe.) Embodiment 30 may have a diameter of approximately one inch. In embodiment 30, outer and inner concentric chambers 42, 44 (FIGS. 2–3) serve as first and second parts 16, 18 of bifurcated chamber 20 (FIG. 1), transfer mechanism 24 (FIG. 1) includes piston 46 and spring 48, and passage 22 (FIG. 1) includes passages 50, 52 and may have an overall width of approximately two to four times the thickness of a human hair. A piston ring 54 is disposed within outer chamber 42. The air under pressure causes the piston ring to drive the RT material through the passages into the inner chamber. The RT material driven into the inner chamber forces piston 46 to move outward of the inner chamber (i.e., downward in FIG. 2), which drives creamy solder out the tube needle. In at least some cases, it is advantageous for the starting positions of the piston 46 and the piston ring 54 and the relative sizes of the outer and inner concentric chambers to be arranged complimentarily and commensurately so that the outer chamber holds most or all of the RT material when the syringe is effectively full and the inner chamber holds most or all of the RT material when the syringe is effectively spent. In a typical embodiment, the amount of RT material used is at least sufficient to effectively fill the inner chamber inward of the piston 46 when the syringe is effectively spent. Stop pins shown as posts in FIG. 2 may be used to block piston 54 from moving beyond a functional point.

The magnet actuating mechanism is able to removably impose a strong magnetic field within the passages so that at least some RT material in the passages undergoes a physical transformation to an effective solid and thereby blocks the flow of RT material through the passages. When the strong magnetic field is so imposed, RT material is blocked from entering the inner chamber, and the piston 46 no longer drives creamy solder out of the tube needle. When the strong magnetic field is removed, the transformed RT material in the passages undergoes a reverting physical transformation, once again allowing RT material to flow from the outer chamber through the passages to the inner chamber, which causes piston 46 to resume driving creamy solder out of the tube needle.

Thus, controlled, noncontinuous outward motion of piston 46 can be derived from air under continuous pressure, because the magnet actuating mechanism can turn the flow of RT material on and off. As a result, creamy solder can be driven out of the tube needle in controlled, desired portions at selected times. For example, a large amount of solder can be dispensed from the syringe at a particular spot by positioning the tube needle over the spot and letting the RT material flow through the passages for a commensurately long period of time.

The magnet actuating mechanism may operate by physically moving a magnet such as a natural magnet or an electromagnet to a position near the passages to impose the strong magnetic field and by physically moving the magnet to another position away from the passages to remove the strong magnetic field. The natural magnet may be or include a rare earth magnet of any size, e.g., a magnet having a diameter up to 2 inches in diameter, such as 1/16 inch, 3/32 inch, 1/8 inch, 0.25 inch, 0.5 inch, 0.75 inch, 1 inch, 1.25 inch, 1.5 inch, 1.75 inch, or 2 inches. Where the magnet is or includes an electromagnet, the strong magnetic field may be imposed by running a high electrical current through the electromagnet and the strong magnetic field may be removed by removing the high electrical current.

It may be desirable for the strong magnetic field to be imposed to block the flow of RT material when the dispensing system is turned off or unexpectedly loses all electrical power, such as in a general or local power failure. In such a case, the magnet actuating mechanism may include a natural magnet and may be arranged so that a force such as gravity or the force of a spring causes the no-power default position of the natural magnet to be near the passages to impose the strong magnetic field. Thus, if a malfunction causes the magnet actuating mechanism to lose electrical power but does not cause the air under pressure to cease pushing on the RT material, the RT material does not continue to flow through the passages, because the natural magnet assumes the no-power default position near the passages to impose the strong magnetic field, which physically transforms the RT material in the passages and thereby blocks the flow. Alternatively or in addition, an electrical sensor may be used to block the flow of RT material when the dispensing system is turned off or unexpectedly loses electrical power.

Piston 46 may have airtight seals both in the inner chamber and in the syringe so that air does not leak past the piston, to help prevent air from disrupting the transfer of force from the air under pressure to the outgoing material.

The dispensing mechanism may also include a direction sensitive mechanism such as a check valve or one-way valve to allow RT material that is in the second part of the bifurcated chamber to be returned quickly to the first part when the dispensing mechanism is to be reset, perhaps after most or all of the outgoing material has been driven as desired. For example, a check valve that effectively provides a small opening for flow in one direction and a large opening for flow in the opposite direction may be used. In such a case, the small opening serves as the passage for the flow of RT material that causes the outgoing material to be driven by the piston, and the large opening serves to allow the RT material to be returned, in a reset procedure, to the first part of the bifurcated chamber faster than the RT material originally flowed out of the first part. For example, as a result, RT material that takes two hours to flow from the first part to the second part can be returned to the first part in much less than two hours.

Depending on the nature of the direction sensitive mechanism used, the direction sensitive mechanism may be largely or entirely self-cleaning, because RT material or other material that becomes undesirably stuck in the walls of the passage and that is not dislodged by the flow of RT material in one direction is highly likely to be dislodged by the flow of RT material in the opposite direction.

Spring 48 may be used in the resetting of the dispensing system. For example, the dispensing system may have two operational states and a resetting state. In the first operational state, the strong magnetic field is not imposed, so the RT material flows through the passage from the first part to the second part of the bifurcated chamber, compressing and thereby storing energy in the spring while driving the outgoing material. In the second operational state, the strong magnetic field is imposed, so the RT material in the passage is effectively solid and therefore blocks the RT material from flowing in either direction despite the air under pressure and the energy stored in the compressed spring. In the resetting state, the strong magnetic field is not imposed and the air under pressure is removed or its pressure is reduced, so the spring de-compresses, releasing its stored energy by driving the RT material back into the first part of the bifurcated chamber, perhaps through a direction sensitive mechanism as described above.

The dispensing system may be used in a reworking application in which a circuit board having one or more missing solder connections is reworked to add the missing solder connections. In the reworking application, the location of a missing solder connection may be determined by a machine vision system, the dispensing system may be aimed at the location, and the activator may cause a controlled amount of creamy solder to be deposited at the location.

The RT material may have the consistency of heavy oil and may be or include MR Fluid by Lord Corporation. MR Fluid is responsive to an NdFeB magnet or an electromagnet. When the passage containing the MR Fluid is near or in contact with the NdFeB or electromagnet, flow through the passage is retarded or stopped within approximately 10 milliseconds.

The dispensing system may be arranged to allow an unused syringe containing creamy solder to be attached to the dispensing system by screwing on and to allow a spent syringe to be removed by unscrewing. In such a case, a half-turn may be sufficient in each screwing direction.

In the passage, the RT material effectively serves as its own switch or valve to turn on and off the flow of RT material from the first part of the bifurcated chamber to the second part. Thus, in a typical embodiment, the passage is much like a section of a water pipe or hose in that the passage has no moving mechanical parts and is sealed off and isolated from the outside without a physical or mechanical connection through the passage wall to an external switch control. In the typical embodiment, the influence of the activator penetrates the passage wall magnetically, not physically or mechanically. As a result, the dispensing system has substantial reliability and maintenance advantages, especially where the passage has a small width.

Figure 4:
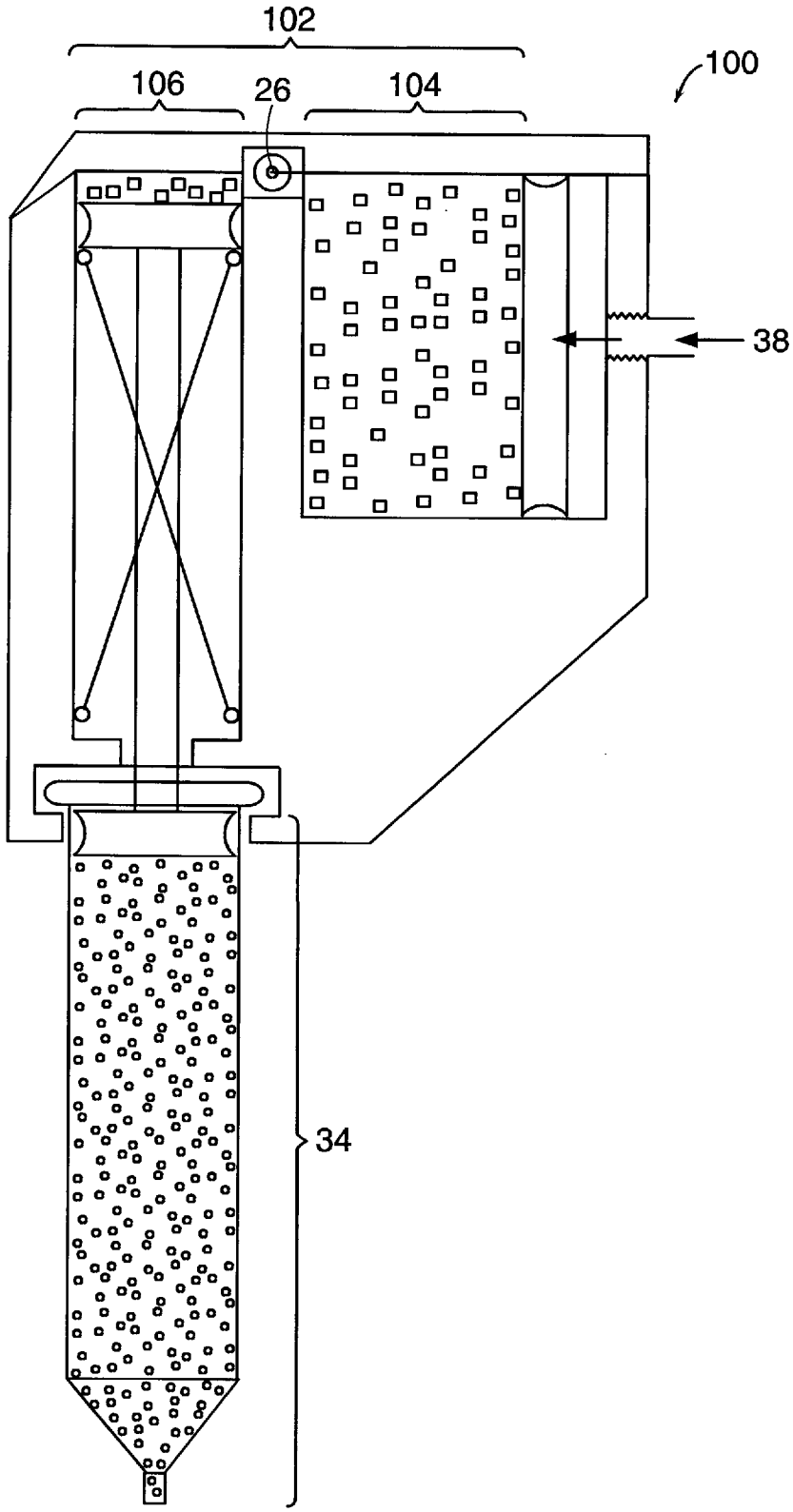

In another embodiment, the dispensing system may have another physical configuration. For example, embodiment 100 shown in FIG. 4 has a bifurcated chamber 102 that has first and second parts 104, 106 that are disposed side by side.

Figure 5A:
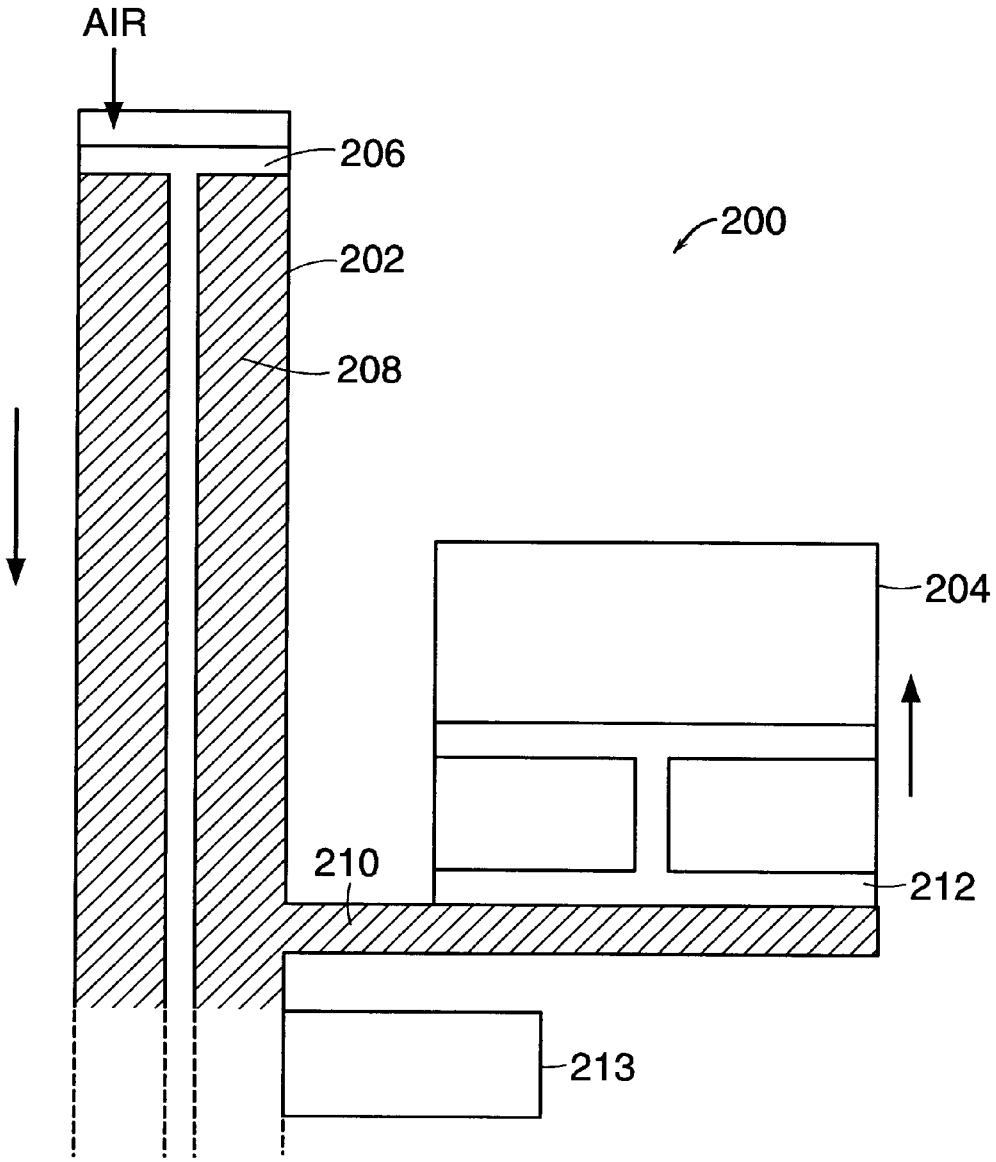
Figure 5B:
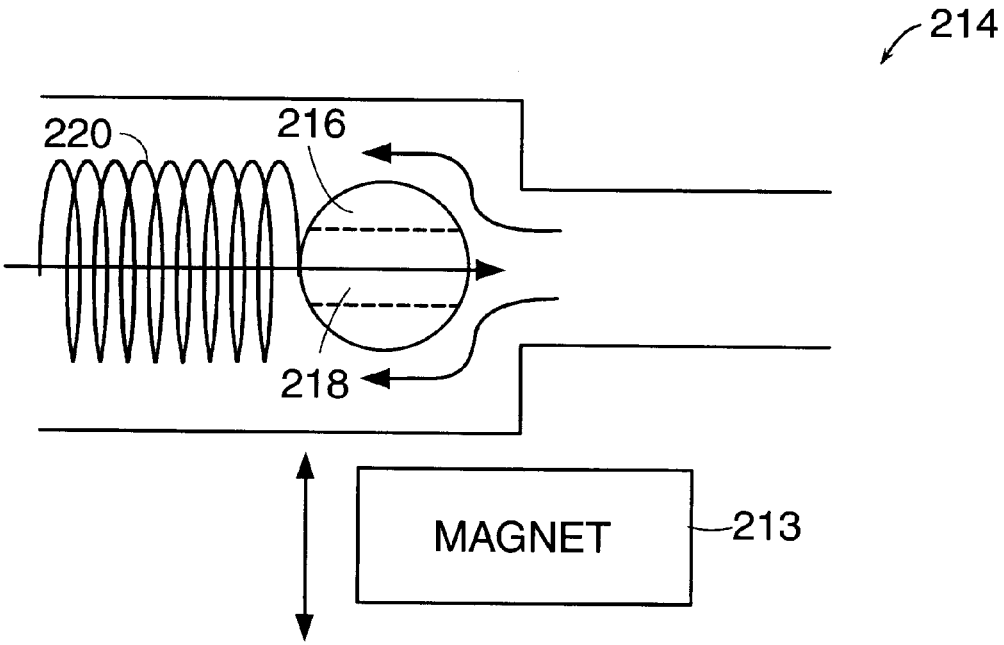
FIG. 5B is a side view of a fluid control mechanism.

FIG. 5A illustrates another embodiment 200 in which the first part 202 is narrow and long and the second part 204 is wide and short. In part 202, piston 206 is driven downward by air that is pumped into part 202 from above. Accordingly, RT material 208 that is disposed below piston 206 is driven through a passage 210 into part 204, thereby driving piston 212 upward. As in the cases described above, a magnetic actuating mechanism 213 is used to control the flow of RT material through the passage. As illustrated in FIG. 5B, a ball check valve 214 including a ball 216 having a narrow passage 218 and being biased by a spring 220 may be used. In such a case, when piston 206 is being driven downward (assuming the magnetic actuating mechanism is set to allow RT material to flow), the RT material can pass through the narrow passage from first part 202 to second part 204, and when piston 206 is being driven back up in a reset procedure after a syringe is spent, the RT material can flow in the opposite direction significantly faster because the ball is moved out of the way by the flow.

Under the same principle of moving a liquid or liquid-like material from one part to another (i.e., from one chamber to another), a fluid material such as hydraulic oil or de-ionized water could be used in place of the RT material. In such a case, a miniature solenoid valve or another switching mechanism such as a pneumatically driven valve or a shuttle valve may be used to control the flow of the fluid material. Such an arrangement might be advantageous in a situation in which the introduction of a magnetic field is undesirable, such as where the magnetic field would adversely affect the material being dispensed. The de-ionized water might be used where an oil leak through the valve or elsewhere would be particularly disadvantageous, in which case surfaces that come in contact with the de-ionized water may be made of or include stainless steel, aluminum, plastic, or other material that is resistant to rust and corrosion from water.

Other embodiments are within the scope of the following claims. For example, the dispensing apparatus may include multiple pistons, perhaps driven by different air supplies, for enhanced flexibility or control or safety. The dispensing apparatus include cascaded pistons or pistons connected in parallel or serial formation. The piston may be driven by electric power or by gravity or by an engine. The chambers may be spaced apart by a substantial distance. The dispensing apparatus may be oriented to dispense material upwards, or horizontally.

What is claimed is:

1. Dispensing apparatus comprising:

a pusher disposed to drive material out of the dispensing outlet;

a first chamber into which the pusher extends, the first chamber configured to contain a hydraulic fluid disposed to drive the pusher;

a second chamber configured to exchange hydraulic fluid with the first chamber; and a fluid control mechanism disposed between the first chamber and the second chamber.

2. The apparatus of claim 1, wherein the hydraulic fluid comprises a rapidly transforming material that reversibly changes from one physical state to another physical state.

3. The apparatus of claim 1, wherein the hydraulic fluid comprises a magnetorheological material.

4. The apparatus of claim 1, wherein the hydraulic fluid comprises hydraulic oil.

5. The apparatus of claim 1, wherein the hydraulic fluid comprises de-ionized water.

6. The apparatus of claim 1, wherein the fluid control mechanism comprises an activator.

7. The apparatus of claim 1, wherein the fluid control mechanism comprises a magnet actuating mechanism.

8. The apparatus of claim 7, wherein the magnet actuating mechanism comprises a natural magnet.

9. The apparatus of claim 7, wherein the magnet actuating mechanism comprises an electromagnet.

10. The apparatus of claim 1, wherein the fluid control mechanism is able to cause a physical transformation in the hydraulic fluid.

11. The apparatus of claim 7, further comprising a spring to urge the magnet actuating mechanism toward the hydraulic fluid.

12. The apparatus of claim 1, wherein the fluid control mechanism comprises a solenoid valve.

13. The apparatus of claim 1, wherein the fluid control mechanism comprises a pneumatically driven valve.

14. The apparatus of claim 1, wherein the dispensing outlet comprises a syringe.

15. The apparatus of claim 1, further comprising a piston disposed within the second chamber.

16. The apparatus of claim 1, further comprising air pressure apparatus to direct air under pressure into the second chamber.

17. The apparatus of claim 1, further comprising a spring disposed to urge the pusher away from the dispensing outlet.

18. The apparatus of claim 1, wherein the first chamber has a proximate end being proximate to the dispensing outlet and a distal end being distal to the dispensing outlet, and the second chamber contains more hydraulic fluid than the first chamber when the pusher is closer to the distal end than the proximate end.

19. The apparatus of claim 1, wherein the first chamber has a proximate end being proximate to the dispensing outlet and a distal end being distal to the dispensing outlet, and the second chamber contains less hydraulic fluid than the first chamber when the pusher is closer to the proximate end than the distal end.

20. The apparatus of claim 1, wherein the fluid control mechanism comprises a direction sensitive mechanism.

21. The apparatus of claim 1, wherein the fluid control mechanism comprises a check valve.

22. The apparatus of claim 1, further comprising a component placer to deposit an electronic component.

23. The apparatus of claim 1, further comprising a machine vision system to identify a location to which the dispensing outlet should be directed.

24. A method of dispensing, comprising:

applying air under pressure to urge a rapidly transforming material to flow toward one portion of a bifurcated chamber from another portion of the bifurcated chamber;

allowing the driven rapidly transforming material to drive a material from a dispensing outlet;

causing at least a portion of the rapidly transforming material to physically transform to a form that is more resistant to flowing;

causing the dispensing outlet to change position; and causing the at least a portion of the rapidly transforming material to physically transform away from the form that is more resistant to flowing.

25. Apparatus comprising:

a dispensing outlet; and a mechanism configured to drive material through the dispensing outlet, the mechanism including rapidly transforming material that reversibly changes from one physical state to another physical state to affect the driving of the material.

* * * * *